US005432687A

United States Patent [19]

Lane

[11] Patent Number: 5,432,687

[45] Date of Patent: Jul. 11, 1995

[54] ILLUMINATED WRITING PAPER MEMO SYSTEM

[76] Inventor: Samuel H. Lane, 2409 Preston, Tyler, Tex. 75071

[21] Appl. No.: 286,663

[22] Filed: Aug. 5, 1994

[51] Int. Cl.[6] ..... F21V 33/00

[52] U.S. Cl. ..... 362/99; 362/97; 281/7; 281/51

[58] Field of Search ..... 362/97, 98, 99, 109; 281/6, 7, 8, 14, 51; 462/27, 84

[56] References Cited

U.S. PATENT DOCUMENTS

| | | | |
|---|---|---|---|
| 1,279,820 | 9/1918 | Brassard | 362/99 |
| 1,320,537 | 11/1919 | Dimond | 362/99 |
| 2,054,459 | 9/1936 | Burt | 362/99 |
| 2,629,043 | 2/1953 | Holtje | 362/99 |
| 3,083,487 | 4/1963 | Hagood, Sr. | 281/8 |
| 3,321,616 | 5/1967 | Adler | 362/99 |
| 3,356,839 | 12/1967 | Mehess et al. | 362/99 |
| 3,484,952 | 12/1969 | Coldren | 281/6 |
| 4,969,068 | 11/1990 | Williams | 362/99 |

FOREIGN PATENT DOCUMENTS

| | | | |
|---|---|---|---|
| 817861 | 9/1937 | France | 362/98 |
| 256849 | 8/1926 | United Kingdom | 362/98 |

*Primary Examiner*—James C. Yeung
*Assistant Examiner*—Alan B. Cariaso
*Attorney, Agent, or Firm*—Geoffrey A. Mantooth

[57] ABSTRACT

An illuminated writing paper memo system for writing in the dark or low light conditions is provided. The device has removably coupled base and body sections. The base section includes a roll of writing paper. The body section has a translucent panel located in an upper portion of the body section and a lighting system located below the translucent panel. The lighting system includes a light bulb located in a light socket, batteries located in a battery holder, and a switch for operably controlling the light bulb. The lighting system is secured to the body in an interior cavity formed in the body below the translucent panel. The roll of paper is journaled to one end of the base section within the coupled base and body sections. Paper is delivered lengthwise across the base to a slot formed between the body and the base. The paper extends out of the slot over the translucent panel for writing purposes. The paper located in the base reflects light from the light bulb through the translucent panel. The removably coupled base and body sections provide easy access to the paper in the base and the lighting system in the body.

8 Claims, 1 Drawing Sheet

FIG. 1
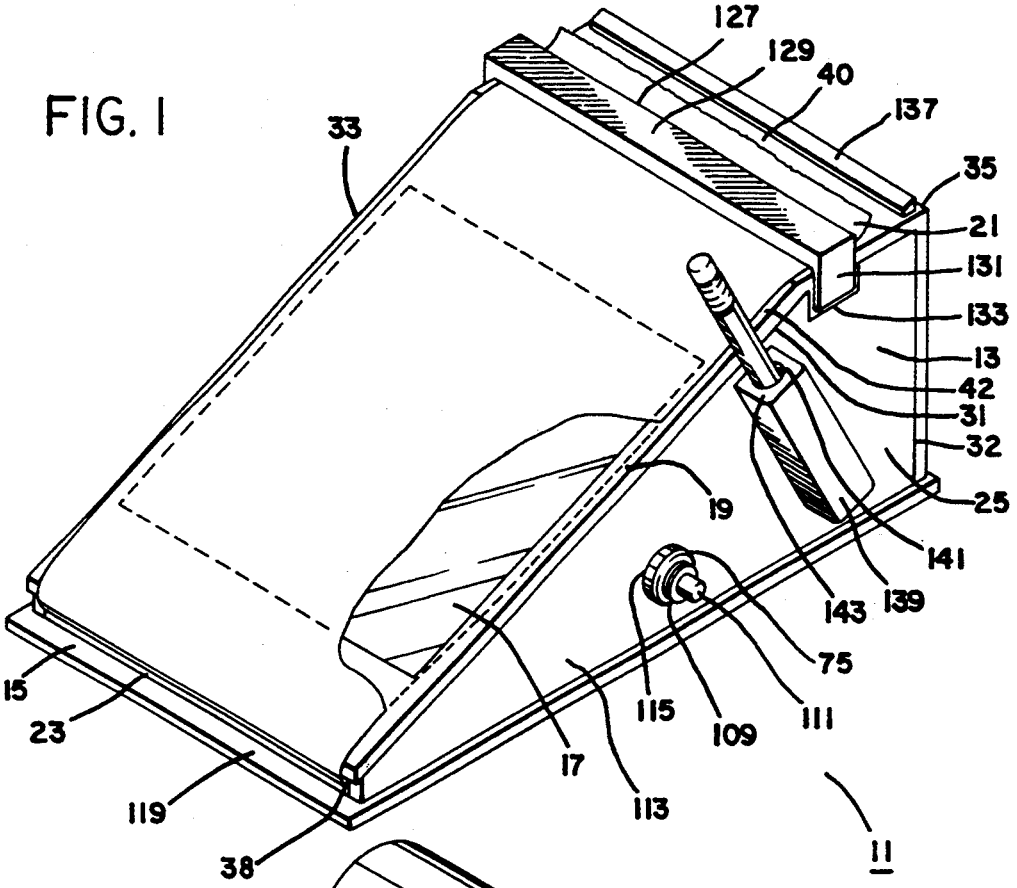
FIG. 2
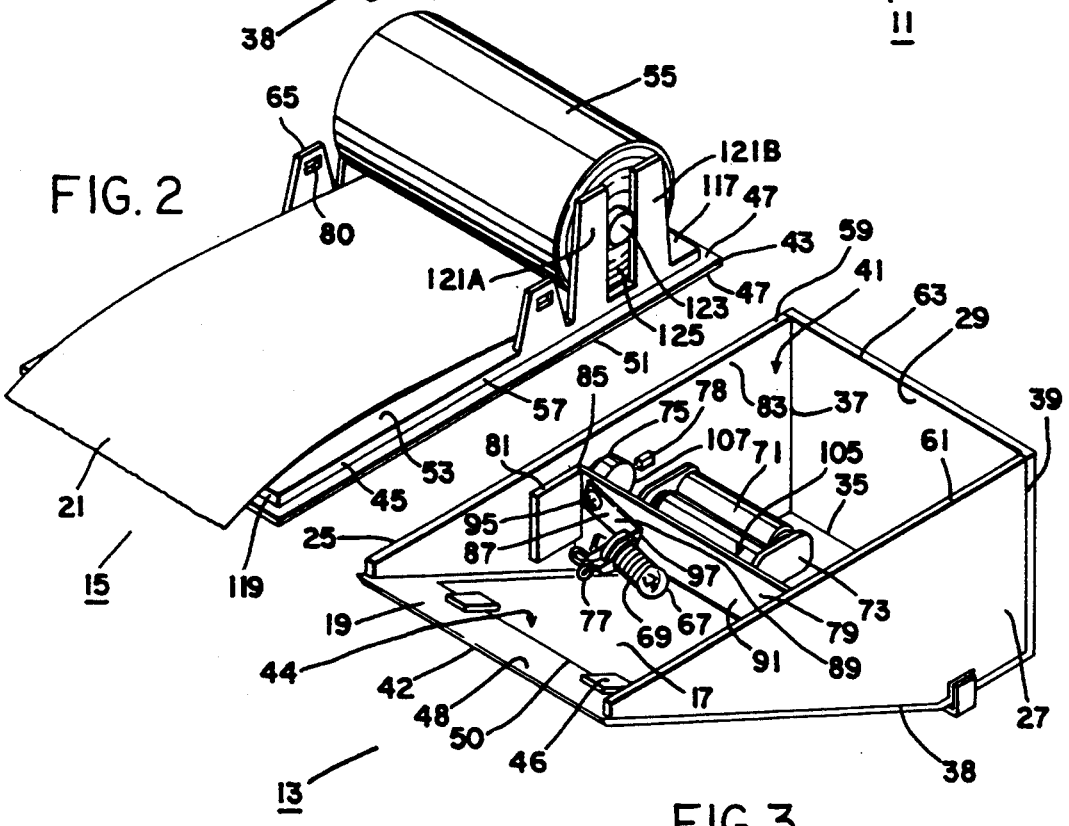
FIG. 3

ILLUMINATED WRITING PAPER MEMO SYSTEM

FIELD OF THE INVENTION

The present invention relates to support devices to aid in writing, and in particular to an illuminated device for enabling a user to write in low light conditions.

DESCRIPTION OF THE PRIOR ART

Illuminated writing pads are used to permit writing in the dark or low light conditions. An illuminated pad may be used to write bedside notes or notes in a darkened public area such as a darkened aircraft without disturbing anyone around the notewriter. An illuminated pad may also be used to write messages in the dark in military situations requiring light discipline.

Williams, U.S. Pat. No. 4,969,068, Dimond, U.S. Pat. No. 1,320,537, Brassard, U.S. Pat. No. 1,279,820, and Holtje, U.S. Pat. No. 2,629,043, all provide illuminated writing devices. The illuminated writing devices typically include a translucent panel beneath which is a system for illuminating the panel, and a paper supply which may be extended over the panel. The panel and the paper are illuminated by the illuminating system so the paper may be legibly written upon in the dark. Typically, the devices include a reflector located opposite the translucent panel to reflect light directed away from the panel back through the panel, increasing illumination of the panel and preventing light from escaping the device at an undesired location.

Replacement of elements of the illuminating system or refilling the paper supply of an illuminating writing device is a tedious chore which requires substantial disassembly of the device. Screws or other retaining members must be loosened and removed, or several pieces of the device must be disconnected and removed in order to obtain access to the illumination system or the paper. After replacing the elements or the paper, the entire device must then be reassembled.

Furthermore, the reflector typically included in an illuminated writing pad device takes up extra space in the device and adds additional weight to the device. The space taken up by the reflector could be used for extra paper, and the additional weight added by the reflector reduces the portability of the device in proportion to the weight of the reflector.

Therefore, what is needed is an illuminated note pad writing device that provides simple and easy access to the paper and to the illuminating system. Furthermore, a reflector is needed that is lightweight and does not take up extra space in the device.

SUMMARY OF THE INVENTION

It is, therefore, an object of the invention to provide an illuminated writing paper memo system having an easily accessible illuminating system and paper supply.

It is further object of the invention to provide an illuminated writing paper memo system wherein the paper supply in the writing device acts as a reflector to enhance illumination of the writing surface of the device.

An illuminated writing paper memo system is provided having a writing case member that is removably coupled to a paper delivery member. The writing case member has a panel that is at least translucent. The translucent panel has an exterior portion and an interior portion, where the exterior portion is structured and arranged to accept paper. A light and a switch are coupled to the writing case member with the light being located adjacent to the interior portion of the translucent panel. The switch and the light are electrically connected.

The paper delivery member has a wall with an interior portion. The interior of the paper delivery member wall is structured and arranged to store a roll of paper.

The writing case member couples the paper delivery member so that the interior portion of the translucent panel is adjacent the interior portion of the paper delivery member wall. At least one of the writing case member and the paper delivery member have a slot located adjacent an end of the translucent panel so that when the writing case member and the paper delivery member are coupled together the slot is structured and arranged to accept a portion of the paper.

The present invention provides an illuminated writing paper memo system that is both easy to operate and maintain. When the light is energized, the paper that overlays the translucent panel is illuminated. The paper is kept taut on the translucent panel by a guide and by the paper rounding over an edge of the unit.

To replace paper or batteries, the unit disassembles into two components, namely a writing case member and a paper delivery member. The lighting system is fully contained within the writing case member, while the roll of paper is fully contained within the paper delivery member. This arrangement makes disassembly easy. In addition, the design is simplified in that no discrete reflector for the light is provided. Instead, an unobstructed path from the light to the paper (that is laid flat from the roll to a slot) and from the paper to the translucent panel is provided. This unobstructed path permits the paper to act as a reflector.

BRIEF DESCRIPTION OF THE DRAWINGS

FIG. 1 is a perspective view of the illuminated writing paper memo system of the present invention in accordance with a preferred embodiment.

FIG. 2 is a perspective view of the base of the illuminated writing paper memo system of FIG. 1.

FIG. 3 is a perspective view of the body, shown in an inverted position, of the illuminated writing paper memo system.

DESCRIPTION OF THE PREFERRED EMBODIMENT

Referring now to FIG. 1, a preferred embodiment of the device 11 for writing in the dark of the present invention is shown. The device 11 has separable body and base sections 13 and 15 which are removably coupled together. The body 13 includes a translucent panel 17 located in an upper wall 19 of the body 13 that may be illuminated by lighting secured within the interior of the body beneath the panel 17. The base 15 holds and dispenses paper 21 through a guide slot 23 for location over the translucent panel 17. The paper is positioned in the interior of the base 15 to reflect light from the lighting in the body 13 through the translucent panel 17 to enhance illumination of the panel. The body 13 and the base 15 are easily separable so that components of the lighting located within the body 13 are easily accessible for replacement, and so that additional paper may be easily added to the base 15.

As shown in FIGS. 1 and 3, the body 13 has a casing having side walls 25 and 27, a back wall 29, and the upper wall 19. In the description that follows, reference is made to the orientation of the device 11 as shown in FIG. 1. The upper wall 19 is integrally coupled to and extends between the top edges 31 and 33 of the side walls 25 and 27, respectively. The back wall 29 is integrally coupled with the back edge 35 of the upper wall 19 and the back edges 37 and 39 of the side walls 25 and 27, respectively. The walls 19, 25, 27, and 29 extend about and define an interior cavity 41 which may be located over the base 15 and in which the lighting unit is located. In a preferred embodiment, the casing of the body 13 is formed of any suitable durable plastic which is lightweight yet sturdy.

Referring to FIG. 1, the upper wall 19 of the body 13 is formed of an upper section 40 and a lower section 42. The upper section 40 extends from the back edge 35 to the lower section 42. The lower section 42 extends downwards from the upper section 40 to the guide slot 23 at the forward end 38 of the body 13 at an acute angle relative to the upper section 40. Thus, the lower section 42 is sloped relative to the upper section 40 so as to provide a suitable writing surface.

Referring now to FIG. 3, the translucent panel 17 is centered and supported in the lower section 42 of the upper wall 19. A panel aperture 44 in which the panel 17 is located extends through the lower section 42. Plural panel supports 46 are coupled to the inner face 48 of the lower section 42 extending into the panel aperture 44 along edges 50 of the panel aperture. The translucent panel 17 is positioned in the aperture 44 on the panel supports 46. In a preferred embodiment, the panel 17 is secured to the panel supports 46 by a suitable adhesive or snap fitted. The top surface of the panel 17 is flush with the top surface of the lower section 42. Both top surfaces are hard and smooth so as to form a suitable writing surface. The translucent panel 17 may be made of plastic material. The panel 17 is at least translucent. It can be transparent.

As shown in FIG. 2, the base 15 has a base platform 43 with a raised floor 45 centered on the base platform 43 extending over a substantial portion of the base platform. The base platform 43 has a flat bottom surface 47 upon which the device 11 rests. The base platform 43 also has a flat top surface 49 which is integrally coupled to the floor 45. Base edges 51 join the bottom surface 47 and the top surface 49 of the base platform 43. The floor 45 has a flat upper surface 53 upon which the paper 21 from a paper roll 55 may rest. Floor edges 57 join the floor 45 and the top surface 49 of the base platform 43, forming a step between the upper surface 53 of the floor 45 and the top surface 49 of the base platform.

Referring now to FIGS. 1–3, the body 13 of the device 11 is removably coupled to the base 15 over the floor 45 of the base. The body 13 is positioned over the base 15 so that the upper wall 19 of the body 13 is located over floor 45 of the base with the interior cavity 41 of the body located between the upper wall 19 and the floor 45. The lower portions of the side walls 25 and 27 and the back wall 29 of the body 13 are positioned abutting the floor edges 57 with bottom edges 59, 61 and 63, respectively, located on the top surface 49 of the base platform 43.

Coupling guides 65 affixed to the base 15 position the side walls 25 and 27 of the body 13 widthwise over the floor 45 of the base 15 and removably couple the body and base together. Each coupling guide 65 is coupled to the upper surface 53 of the floor 45 along an elongated floor edge 57 extending upwards from the floor. The side walls 25 and 27 of the body 13 fit snugly about the coupling guides 65 to correctly position the body widthwise on the base 15. The side walls 25 and 27 and the coupling guides 65 are detachably coupled together. In a preferred embodiment, a boss 78 extending from each side wall 25, 27 is located in a catch or depression 80 in a respective coupling guide 65 to removably couple the body and base together. The body 13 and base 15 may be joined by firmly pushing the body and base together until the boss is located in the catch, and may be separated by firmly pulling the body apart from the base. Other conventional mechanisms may be used instead of the boss mechanism to removably couple the body and base together. For example, screws extending through the sidewalls 25, 27 and the guides 65 could be used.

Referring to FIG. 3, the lighting for the device 11 is shown located in the interior cavity 41 of the body 13 of the device 11. The lighting is comprised of a light bulb 67 located in a light socket 69 which is energized by batteries 71 located in a battery holder 73 and which is operably controlled by a switch 75. The light bulb 67 may be any of a number of conventional, commercially available light bulbs adapted for direct current use. The light socket is a conventional, commercially available socket for holding the light bulb 67. The batteries 71 are conventional flashlight batteries which are mounted in conventional flashlight battery holder 73. In a preferred embodiment, two AA penlight flashlight batteries are mounted in the battery holder 73. Wires 77 extend between and electrically connect the light socket 69, the battery holder 73, and the switch 75. The lighting is fully contained within the body 13 of the device so that the light bulb 67 or batteries 71 may be easily accessed for replacement simply by removing the body 13 from the base 15 and exposing the interior cavity 41 of the body.

The light socket 69 and the battery holder 73 are mounted in the interior cavity 41 on a cross brace 79. The cross brace 79 is an elongated rectangular bar mounted to the side walls 25 and 27 extending transversely between the side walls across the interior cavity 41 directly beneath the translucent panel 17. Parallel brace supports 81 are coupled to the inner face 83 of each side wall 25 and 27; respectively, between which the ends 85 of the cross brace 79 are secured. The cross brace 79 may be secured between the cross brace supports 81 by conventional means such as adhesives, screws, or bolts.

The light socket 69 is mounted to the cross brace 79 by an L-shaped light mount 87. A coupling leg 89 of the light mount 87 extends along the forward face 91 of the cross brace 79 and is coupled to the cross brace. A screw 95 extends through the coupling leg 89 to secure the light mount 87 to the cross brace 79. A mounting arm 97 of the light mount 87 is integrally coupled to the coupling leg 89 extending transverse to the coupling leg. The light socket 69 is mounted on the mounting arm 97. The light mount 87 positions the light socket 69 directly beneath (relative to orientation of FIG. 1) and adjacent to the translucent panel 17 in the upper wall 19 so that light from the light bulb 67 mounted in the light socket 69 directly illuminates the panel 17. The bulb is separated from the panel 17 by a gap.

The battery holder 73 is mounted in the interior cavity 41 of the body 13 on the rear face 105 of the cross brace 79. The battery holder 73 is directly mounted to the cross brace 79. In a preferred embodiment, the battery holder 73 is mounted to the cross brace 79 by conventional mounting means such as adhesives, bolts, or rivets.

The switch 75 is mounted extending through side wall 25 adjacent to the cross brace end 85 and the brace supports 81 on the side wall 25. The switch 75 is a conventional push button switch which alternatively completes a circuit connecting the batteries 71 to the light bulb 67 to light the bulb 67 or interrupts a circuit between the batteries 71 and the light bulb 67 to turn the bulb 67 off. An interior portion 107 of the switch 75 is located against the inner face 23 of the side wall 25. As shown in FIG. 1, an exterior portion 109 of the switch 75, including push button 111, is located extending from the outer face 113 of the side wall 25. The exterior portion 109 of the switch 75 includes a switch nut 115 which secures the switch to the side wall 25. Although a push button type switch is preferred, other switches, such as sliding type switches may be employed in the device 11.

Referring now to FIGS. 2 and 3, the paper dispensing mechanism in the base 15 is shown. Paper 21 is dispensed from a paper roll 55 in a continuous sheet across the upper surface 53 of the floor 45 so that light from the bulb 67 in the interior cavity 41 above the upper surface 53 may be reflected off the paper 21 and then through the translucent panel 17. The paper roll 55 is located on upper surface 53 of the floor 45 at a roll dispensing end 117. Paper 21 extends across the floor 45 from the roll 55 to a paper dispensing end 119 of the floor 45. As shown in FIG. 1, the paper 21 extends from the paper dispensing end 119 of the floor 45 through the guide slot 23 so that the paper 21 may be pulled through the guide slot 23 to be located over the translucent panel 17. In a preferred embodiment, the paper 21 is light-colored, preferably white, to better reflect light from the bulb 67 back through the translucent panel 17.

Referring back to FIG. 2, a pair of roll retainers 121A and 121B is located on each opposing elongated floor edge 57 near the roll dispensing end 117 of the floor 45 to hold the paper roll 55 in the base 15. Each roll retainer pair 121A and 121B extends upwards from its respective floor edge 57 a distance greater than the height of a paper roll axle 123 which is located extending centrally through the paper roll 55. An axle slot 125 is located extending vertically between each pair of roll retainers 121A and 121B. The axle slots 125 of the opposing pairs of roll retainers 121A and 121B cooperatively receive and secure the paper roll axle 123 between them. The paper roll axle 123 is rotatably secured in the axle slots 125 so that paper 21 wound about the paper roll axle 123 may be unwound by rotating the paper roll 55 about the paper roll axle 123 without displacing the paper roll axle and the paper roll 55 from between the pairs of roll retainers 121A and 121B. The paper roll 55 and the roll retainers 121A and 121B fit within the interior cavity 41 of the body 13 when the body is located over the base 15. More specifically, the paper roll 55 is located beneath the upper section 40 of the body. The paper roll 55 bears on the upper surface 53. The paper 21 is unwound from the bottom of the paper roll 55. Thus, the paper is pinched between the roll 55 and the upper surface 53, which pinching provides tension to the paper.

Referring now to FIG. 1, the paper 21 extends through the guide slot 23 out from within the assembled body 13 and base 15. The paper 21 is folded back over the forward end 38 of the upper wall 19 to extend over the translucent panel 17. The guide slot 23 is only slightly wider than the width of the paper 21 so the guide slot 23 aligns the paper as the paper is drawn through the guide slot.

Referring still to FIG. 1, the paper 21 is held in place over the translucent panel 17 by a retaining guide 127. The guide 127 is removably coupled to the body 13 and extends across the upper section 40 of the upper wall 19 transverse to the direction the paper 21 moves across the upper wall. The paper 21 is pinched between the retaining guide 127 and the body 13. The retaining guide 127 maintains the paper 21 in a position for writing on the translucent panel 17 while permitting the paper to be drawn through the guide 127 to enable written sections of paper to be removed from the panel 17.

The retaining guide 127 is a U-Shaped rectangular bar having an elongated center portion 129 and arms 131. The arms 131 are integrally coupled to the center portion 129 extending transverse to the center portion 129 at opposite ends of the center portion. The arms 131 removably couple to the side walls 25 and 27, in guide channels 133 located in the side walls 25 and 27 so that the retaining guide 127 snaps into place across the upper wall 19. When the arms 131 are located in the guide channels 133 the center portion 129 is located extending across the upper wall 19 slightly above the upper section 40. The paper 21 extends between the arms 131 of the retaining guide 127 over the upper wall 19 and under the center portion 129. The center portion 129 is located closely proximate to the upper section 40 to keep the paper 21 taut over the lower section 42 and translucent panel 17 while preventing the paper from being pulled out from under the retaining guide 127. The retaining guide 127 is removable so that the device 11 may be operated without the retaining guide 127 if desired.

Referring still to FIG. 1, the body 13 includes means for tearing used paper off of the device 11. A tearing edge 137 is coupled to the upper wall 19 extending along the back edge 35 of the upper wall. The tearing edge 137 is angled upwards from the upper section 40 of the upper wall 19 so that the paper 21 may be torn by sharply pulling the paper downwards against the tearing edge 137.

A pencil and pen holder 139 is mounted to the outer face 113 of the side wall 25 so that a pencil or a pen may be conveniently located with the device 11. The holder 139 is an elongated box having a cylindrical aperture 141 extending lengthwise through the box for a substantial portion of the length of the box. One side of the holder 139 is integrally coupled to the outer face 113 of the side wall 25 so that a top face 143 of the holder is located extending parallel to the lower section 42 of the upper wall 19. The cylindrical aperture 141 is centered extending through the top face 143 of the holder. A pencil or pen may be located and held within the aperture 141 in the holder 139.

To use the device 11, a roll of paper 55 is located between the pairs of roll retainers 121A and 121B by inserting the axle 123 into the axle slots 125. Paper 21 from the roll 55 is pulled across the floor 45 of the base 15 to the paper dispensing end 119 of the base. Then, the body 13 is located over the base 15 with the paper 21 extending out of the guide slot 23 formed at the forward end 38 of the joined body 13 and base 15. The base 15 and the body 13 are coupled together by snap fitting the bosses 78 of the base 15 into the depressions 80 in the coupling guides 65. The paper 21 is then pulled over the translucent panel 17 and the upper section 40 of the upper wall 19 and is secured in place by coupling the retaining guide 127 to the body 13. Thus, the paper 21 is held taut on the panel 17 by the retaining guide 127 and edge 38.

The switch 75 is then toggled to complete the circuit between the batteries 71 and the light bulb 67, causing the batteries 71 to supply energy to the light bulb 67, lighting the bulb 67. The light from the bulb 67 escapes through the translucent panel 17, both directly and also by reflection from the paper 21 in the base 15. The light escaping through the translucent panel 17 illuminates the paper 21 located over the panel 17 so that the paper 21 may be written on and read in the dark.

Used paper may be torn off by grasping the free end of the paper, pulling the paper to advance clean paper onto the transparent panel, and sharply pulling the paper against the tearing edge 137.

Occasionally, the batteries 71, light bulb 67, or paper roll 55 may need to be replaced. The device is easily disassembled into two parts: the base 15 with the paper, and the body 13 with the electrical components. In order to replace these items, the body 13 is pulled apart from the base 15 to expose the floor 45 of the base 15 and the interior cavity 41 of the body 13. The paper roll 55 is replaced by removing the old paper roll axle 123 from the axle slots 125 and locating a new paper roll in place of the old paper roll axle. The light bulb 67 is changed by removing the old light bulb 67 from the socket 69 and replacing it with a new bulb 67. The batteries 71 are changed by removing the old batteries 71 from the holder 73 and replacing them with new batteries 71. After all the required changes have been made, the device 11 is reassembled by positioning the side walls 25 and 27 of the body 13 over the coupling guides 65 of the base 15 and firmly pushing the body 13 and base 15 together until they are joined.

The foregoing disclosure and showings made in the drawings are merely illustrative of the principles of the invention and are not to be interpreted in a limiting sense.

I claim:

1. An illuminated writing paper memo system, comprising:

a writing case member having a panel that is at least translucent, said panel having an exterior portion that is structured and arranged to receive paper and an interior portion, said panel having an end;

said writing case member having a light and a switch coupled thereto, said light being electrically connected to said switch, said light being located adjacent to said interior portion of said panel, said light and said switch being coupled to said writing case member;

a paper delivery member having a base wall with an interior portion, said paper delivery member having two side walls extending from said paper delivery, member interior portion, said side walls being spaced apart from each other;

a roll of paper, said roll being located between said side walls;

said writing case member being removably coupled to said paper delivery member such that said interior portion of said panel is adjacent to said interior portion of said paper delivery member base wail, with at least one of said writing case member and said paper delivery member having a notch that is located adjacent to said end of said panel, said notch forming a slot when said writing case member and said paper delivery member are coupled together, said slot receiving a portion of said paper wherein said paper forms a path from said roll, through said slot and on said panel.

2. The illuminated writing paper memo system of claim 1 further comprising:

a power source for energizing said light, said power source being electrically connected with said light and said switch, said power source being coupled to said writing case member.

3. The illuminated writing paper memo system of claim 1, further comprising:

a paper guide removably coupled to and extending across an exterior of said writing case member adjacent a second end of said translucent panel, where said translucent panel is located between said paper guide and said slot;

said paper extends from said slot over and across said exterior portion of said translucent panel and through said paper guide.

4. An illuminated writing paper memo system, comprising:

a case having a first wall that is at least translucent, said translucent wall having an end, said case having a second wall that is spaced apart from said first wall so as to form a cavity therein;

a supply of light colored paper located in said cavity adjacent to said second wall, said paper supply forming a sheet that extends along said second wall;

an opening for removing said sheet of paper from said cavity, said opening being located near said end of said first wall;

a light located in said cavity between said first wall and said paper sheet, said cavity providing an unobstructed path for visible light from said light to said sheet of paper, and from said sheet of paper to said first wall;

said case is comprised of a writing case member and a paper delivery member removably coupled together; where said cavity is formed within said coupled writing case member and said paper delivery member;

said first wall is located in said writing case member and said light is located in said cavity coupled to and extending from said writing case member;

said second wall is located in said paper delivery member and said paper supply is located in said cavity and coupled to said paper delivery member.

5. The illuminated writing paper memo system of claim 4, wherein:

said supply of paper is located near an end of said second wall;

said sheet extends from said supply of paper along said second wall to said opening, said opening being located opposite said supply of paper.

6. The illuminated writing paper memo system of claim 4 further comprising:

a power source for powering said light;

a switch electrically connecting said power source and said light so that said light may be turned on and off.

7. The illuminated writing paper memo system of claim 4, wherein said paper supply is a roll of paper which is journalled in said case.

8. The illuminated writing paper memo system of claim 4, further comprising:

a paper guide removably coupled to and extending across said first wall of said case along an exterior of said case, where said translucent panel is positioned between said paper guide and said opening;

said sheet of paper extends through said opening across said translucent panel and through said paper guide.

* * * * *